United States Patent [19]

Ackerman, Jr.

[11] 3,979,848

[45] Sept. 14, 1976

[54] ADJUSTABLE BASE AND MOUNT FOR FIREARM OPTICAL SIGHT

[75] Inventor: William R. Ackerman, Jr., El Paso, Tex.

[73] Assignee: W. R. Weaver Company, El Paso, Tex.

[22] Filed: Apr. 25, 1975

[21] Appl. No.: 572,494

[52] U.S. Cl. ..... 42/1 S; 33/248

[51] Int. Cl.[2] ..... F41G 1/38

[58] Field of Search ..... 42/1 S, 1 ST; 33/233, 33/245, 247, 248, 252

[56] References Cited

UNITED STATES PATENTS

| | | | |
|---|---|---|---|
| 2,103,539 | 12/1937 | Kuhn | 33/248 |
| 2,112,268 | 3/1938 | Burton | 42/1 S |
| 2,576,347 | 11/1951 | Jones | 33/247 |
| 2,854,748 | 10/1958 | Williams | 33/248 |
| 3,834,052 | 9/1974 | Steck | 42/1 ST |
| 3,922,794 | 12/1975 | Ackerman, Jr. | 42/1 ST |

*Primary Examiner*—Charles T. Jordan

*Attorney, Agent, or Firm*—Donald R. Motsko; William W. Jones

[57] ABSTRACT

An adjustable base suitable for mounting an optical sight on a firearm. The base contains spring-biased windage and elevation adjustments and a provision for locking the base in place to assure location accuracy and to absorb the firearm recoil.

11 Claims, 3 Drawing Figures

ADJUSTABLE BASE AND MOUNT FOR FIREARM OPTICAL SIGHT

This invention relates to a mount for securing an optical sighting device to a firearm, and more particularly to a mount of the type having provision for making windage and elevation adjustments for the sight.

Gunsight mounts which are movable on a gun to compensate for windage and elevation variance are not broadly new to the prior art. Such mounts are the subject of many patents and the development of such mounts has been extensive. Mounts of this type are useful when, for whatever reason, it is undesirable to provide internal adjustment mechanisms within the sight itself to correct for windage and elevation corrections.

Despite the relatively extensive development of this general concept, specific mounts of this type remain complex, often requiring two hands to make the adjustments required.

The mount of this invention is of relatively simple construction, can be adjusted for both windage and elevation with only one hand, and can, once adjusted, be locked into position by a simple one-handed manipulation so that jostling, recoil, or the like, will not disturb the desired positioning of the sight.

The mount assembly of this invention includes a base which is adapted to be secured to a firearm, a plate which is mounted on the base, and a cradle which is secured to and moves conjointly with the plate. Provision is made for establishing a ball-socket type lock joint between the base and plate so that the plate can be universally pivoted with respect to the base about pivots on either side of the lock joint. A windage spring is sandwiched between the base and plate to bias the plate laterally (or horizontally) of the base, and an elevation spring is sandwiched between the base and plate to bias the plate vertically of the base. Windage and elevation adjustments are provided to respectively move the plate horizontally and vertically of the base against the bias of the windage and elevation springs. The ball and socket joint is provided with a lock-relase feature that permits loosening of the joint for adjusting the line of sight and subsequent tightening of the joint so that the adjusted line of sight will be maintained.

It is, therefore, an object of this invention to provide a mount assembly for attaching a sighting device to a firearm, which mount assembly can be adjusted to make windage and elevation corrections for the sighting device.

It is a further object of this invention to provide a mount assembly of the character described wherein a plate is mounted on a base for universal pivoting movement with respect thereto, and the base is secured to a firearm.

It is yet another object of this invention to provide a mount assembly of the character described wherein means is provided for loosening and tightening a universal joint between the plate and base to permit and restrict pivotal movement of the plate with respect to the base.

These and other objects and advantages of the mount assembly of this invention will become more readily apparent from the following detailed description of one embodiment thereof taken in conjunction with the accompanying drawings, in which.

Figure 1:
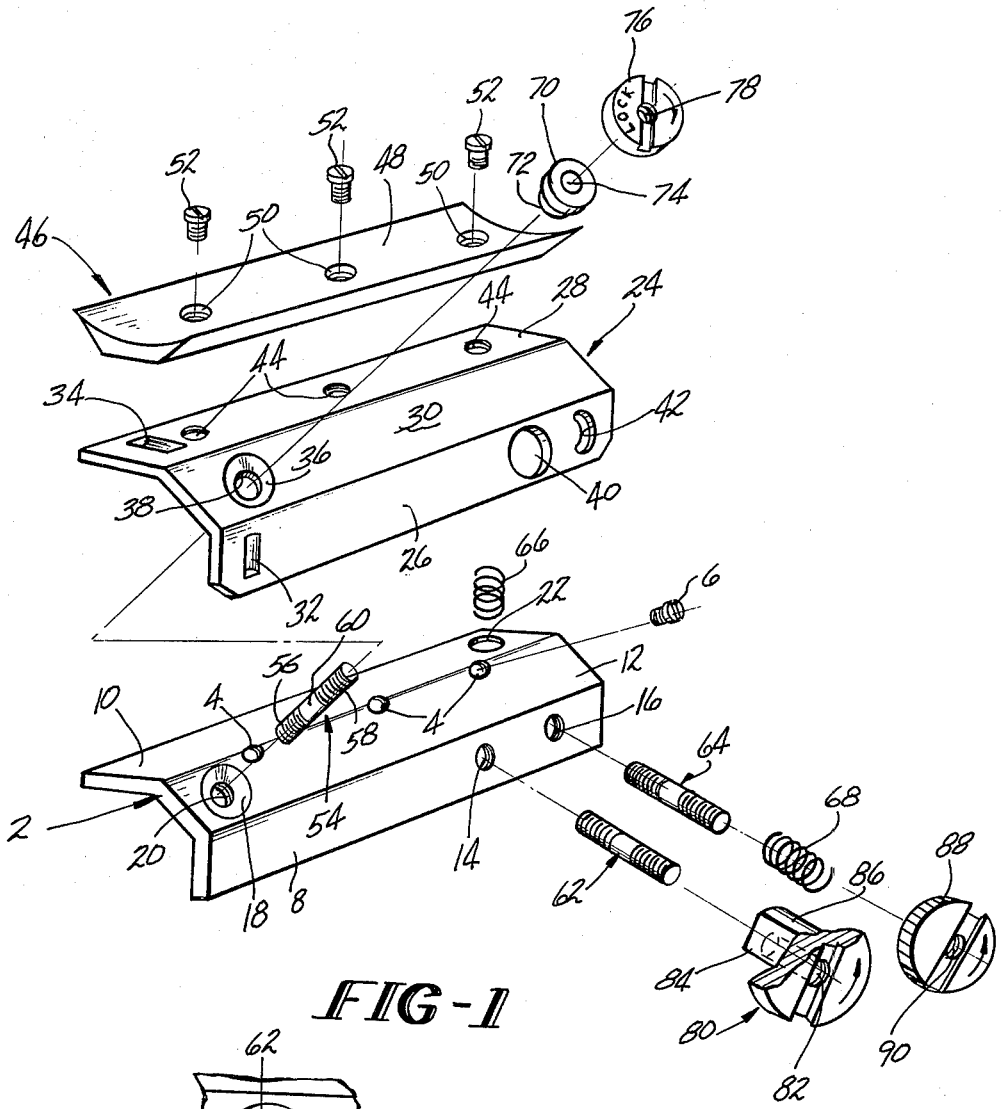
FIG. 1 is an exploded perspective view of one embodiment of the mount assembly of this invention.

Referring now to the drawings, and in particular to FIG. 1, it will be seen that the mount assembly includes a mount base 2 having three counterbored holes 4 through which pass screws 6 used to secure the base 2 to a firearm which has been tapped in a conventional manner. The base 2 also includes a vertical side wall 8, a horizontal top wall 10, and an inclined intermediate wall 12. Two threaded openings 14 and 16 are formed in the vertical side wall 8. A spherical recess 18 is formed in the intermediate tapered wall 12 and there is a threaded opening 20 in the bottom of the spherical recess 18. A cylindrical recess 22 is formed in the horizontal top wall 10.

The mount assembly also includes a plate 24 which overlies the base 2. The plate 24 includes a vertical side wall 26 which is outwardly adjacent to the base vertical side wall 8, a top horizontal wall 28 which is upwardly adjacent to the base horizontal top wall 10, and an intermediate inclined wall 30 which is outwardly adjacent to the intermediate inclined base wall 12. The vertical side wall 26 of the plate 24 is formed with an inwardly protruding dimple or depression 32 which is preferably semi-cylindrical in configuration and the inner surface of which contacts the outer surface of the vertical side wall 8 of the base 2 to form a generally vertical pivotal axis about which the plate 24 can be pivoted horizontally with respect to the base 2. A downwardly protruding dimple or depression 34 is similarly formed in the horizontal top wall 28 of the plate 24. The dimple 34 is also preferably semi-cylindrical in configuration and has a lower surface which contacts the upper surface of the horizontal top wall 10 of the base 2 to form a generally horizontal pivotal axis about which the plate 24 can be pivoted vertically with respect to the base 2. A spherical depression 36 is formed in the inclined wall 30 of the plate 24, preferably by coining, so that there is formed on the underside of the wall 30 a spherical protrusion which fits in and matches the spherical recess 18 formed in the base 2. An opening 38 is formed in the bottom of the depression 36 for coaxial alignment with the opening 20 in the base. An elevation opening 40, which is circular in configuration, extends through the vertical side wall 26 of the plate 24, and adjacent thereto there is disposed an elongated arcuate windage opening 42. A plurality of threaded openings 44 are provided on the horizontal top surface 28 of the plate 24.

A cradle 46 is provided with a top concave surface 48 which is adapted to support and retain a generally cylindrical sighting device, such as a rifle scope or the like. The sight may be secured to the cradle 46 in any known manner, such as, for example, with straps, clamps, or the like. A plurality of counterbored holes 50 are provided through the cradle 46 for co-axial alignment with the threaded plate openings 44.

The mount assembly is assembled as follows. The cradle 46 is secured to the plate 24 by means of screws 52 which pass through the cradle holes 50 and are threaded into the plate openings 44. The base 2 is secured to a firearm by means of the screws 6 being inserted through the base openings 4 and threaded into tapped openings formed in the firearm. A locking post 54 is then screwed into the tapped opening 20 in the base 2, it being noted that the post 54 has opposite end portions 56 and 58 which are threaded and an intermediate portion 60 which is not threaded. An elevation screw 62, which is threaded in the same manner as the locking post 54, is then threaded into the tapped opening 14 in the base 2, after which a similarly threaded windage screw 64 is threaded into the tapped opening 16 in the base 2. An elevation return spring 66 is then seated in the recess 22 in the horizontal top wall 10 of the base 2, and a windage return spring 68 is slipped over the windage screw 64.

The plate 24 is then positioned adjacent to the base 2 by passing the locking post 54 through the plate opening 38, and passing the windage and elevation screws 64 and 62 respectively through the plate openings 42 and 40 respectively. A locking member 70 having a spherical nose 72 and a through axial passage 74 is then dropped onto the locking post 54 so that the spherical nose 72 of the member 70 enters the spherical depression 36 formed in the plate 24. A locking nut 76 having a tapped through bore 78 is then threaded down onto the threaded end 58 of the locking post 54 to secure the plate 24 to the base 2. An elevation nut 80 having a tapped through bore 82 is then screwed onto the elevation screw 62. The elevation nut 80 has a shank part 84 with an outer surface 86 which defines a spiral cam with respect to the axis of the through bore 82. The nut 80 is screwed down onto the screw 62 until the spiral outer surface 86 of the nut shank 84 enters the plate opening 40. A windage nut 88 having a threaded bore 90 is then screwed down onto the screw 64 until the nut 88 bears against the vertical side surface 26 of the plate 24.

Figure 2:
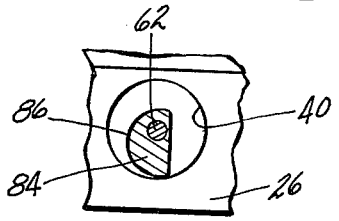
FIG. 2 is a fragmented side elevational view partly in section showing the mode of operation of the elevation adjustment screw of FIG. 1.
Figure 3:
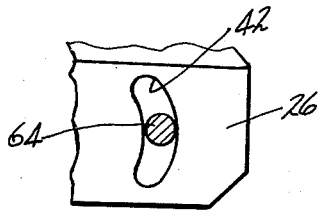
FIG. 3 is a fragmented side elevational view partly in section showing how the windage screw mounting is adapted to permit elevational movement of the mount plate to occur.

The mount assembly operates as follows. Assume that a sight has been positioned on the cradle 46 and secured thereto. The locking nut 76 is backed off so that the locking member 70 will be loosened from the plate 24 enabling the latter to be pivoted horizontally and vertically about the depressions 32 and 34 respectively. It will be appreciated that the spring 66 is operative to bias the plate vertically about the depression 34, and the spring 68 is operative to bias the plate 24 horizontally about the depression 32. By biasing the plate 24 vertically about the depression 34, the spring 66 causes the side of the opening 40 to be biased upwardly into engagement with the spiral surface 86 of the elevation adjustment screw shank 84, as will be most clearly seen from FIG. 2. Thus vertical adjustment of the sight can be made by turning the elevation adjustment nut 80. It will be noted from FIG. 3 that the windage adjustment opening 42 has been appropriately elongated and curved so that it and the windage adjustment screw 64 will not interfere with elevation adjustments. The windage adjustment spring 68 serves to bias the plate 24 horizontally about the depression 32 and against the windage adjustment nut 88. Therefore, windage adjustments are made by merely screwing the nut 88 in or out along the screw 64, the plate 24 following such movement of the nut 88 by reason of the spring 68. After appropriate windage and elevation adjustments have been made by proper manipulation of the windage and elevation nuts 88 and 80 respectively, the lock nut 76 is again tightened down onto the lock screw 54 to lock the plate 24 in the adjusted position.

It will be understood that the axes of the depressions 32 and 34 and the lock screw 54 are all co-planar so that tightening of the lock nut 76 will not impart any pivotal moment to the plate 24, whereby the preset adjustments for windage and elevation will be retained.

The positioning of the windage and elevation nuts side by side for movement along parallel axes simplified adjustment of the mount, and enables both windage and elevation adjustment to be made by the same hand while the shooter views the target through the sight. The use of windage and elevation springs ensures instantaneous movement of the plate and sight when sighting adjustments are made. Provision of a separate locking screw ensures that recoil forces will not be imparted to the windage and elevation screws, but rather will be absorbed by the locking screw which can be fortified for this purpose.

Since many changes and variations of the disclosed embodiment of the invention may be made without departing from the inventive concept, it is not intended to limit the invention otherwise than as required by the apended claims.

What is claimed is:

1. A mounting assembly for securing a sighting device to a firearm, said mounting assembly being of the type having windage and elevation adjustment capabilities and comprising:

a. a first member adapted to be rigidly secured to the firearm;

b. a second member disposed adjacent to said first member and adapted to receive the sighting device;

c. means forming a first pivotal contact between said first and second members whereby said second member is pivotally movable with respect to said first member in a vertical direction about a horizontal pivot axis;

d. means forming a second pivotal contact between said first and second members whereby said second member is pivotally movable with respect to said first member in a horizontal direction about a vertical pivot axis;

e. windage and elevation adjustment means for moving said second member horizontally and vertically about said pivot axes; and f. releasable locking means movable about an axis for selectively locking said second member against pivotal movement with respect to said first member, and releasing said second member for pivotal movement with respect to said first member, said last mentioned axis being substantially coplanar with said pivot axes so that actuation of said locking member does not impart a pivotal moment to said second member.

2. The mounting assembly of claim 1, wherein said locking means includes a threaded locking post secured to said first member and extending through an opening in said second member, and locking nut means threaded onto said locking post for selective tight or loose engagement with said second member.

3. The mounting assembly of claim 2, wherein said locking post absorbs recoil forces imparted to said second member when the firearm is fired.

4. The mounting assembly of claim 1, wherein said windage and elevation adjustment means includes spring means for biasing said second member in both the vertical and horizontal directions away from said first member; a windage screw; an elevation screw; a windage nut threaded onto said windage screw engaging said second member and movable along said windage screw to move said second member horizontally toward said first member; and an elevation nut threaded onto said elevation screw engaging said second member and movable along said elevation screw to move said second member vertically toward said first member.

5. The mounting assembly of claim 4, wherein said windage and elevation screws are secured to said first member and extend through respective openings in said second member, and said windage and elevation screws are parallel to each other.

6. The mounting assembly of claim 5, wherein said windage and elevation screws lie generally in a horizontal plane and are disposed on the same side of said second member so as to lie side by side, and said elevation nut includes a shank portion having a spiral outer surface which contacts a side of the opening in said second member through which said elevation screw extends.

7. A mounting assembly for securing a sighting device to a firearm, said mounting assembly being of the type having windage and elevation adjustment capabilities and comprising:

a. a first member adapted to be rigidly secured to the firearm;

b. a second member disposed adjacent to said first member for receiving the sighting device, said second member comprising pivot means for enabling said second member to be pivoted horizontally and vertically with respect to said first member;

c. spring means interposed between said first and second members for biasing said second member both horizontally and vertically about said pivot means;

d. windage adjustment means secured to said first member and having a portion movable along a first axis against said second member to move the latter horizontally against the bias of said spring means;

e. elevation adjustment means secured to said first member and having a portion movable along a second axis against said second member to move the latter vertically against the bias of said spring means, said second axis being parallel to said first axis; and f. one of said elevation and windage adjustment means being rotatable and movable along its respective axis and including a circumferential cam surface which engages said second member to move the latter when said one of said adjustment means is rotated.

8. The mounting assembly of claim 7, wherein said windage and elevation adjustment means are side by side with respect to each other on one side of said second member.

9. The mounting assembly of claim 7, further comprising locking means selectively actuable to lock said second member against pivotal movement with respect to said first member and release said second member for pivotal movement with respect to said first member.

10. The mounting assembly of claim 9, wherein said locking means includes a post secured to said first member and extending through an opening in said second member, and a locking nut means threaded onto said post for selectively tightening said second member against said first member.

11. The mounting assembly of claim 10, wherein said post is adapted to absorb recoil forces, and has an axis which is substantially coplanar with horizontal and vertical pivotal axes defined by said pivot means whereby tightening of said locking nut means against said second member does not impart a pivotal moment to said second member about said pivot means.

* * * * *